United States Patent [19]

Hoyeck

[11] Patent Number: 4,912,890

[45] Date of Patent: Apr. 3, 1990

[54] AIR/WATER CRANES

[76] Inventor: Ralph H. Hoyeck, 80 Sommerville Ave., Westmount, Québec H3Z 1J5, Canada

[21] Appl. No.: 133,796

[22] Filed: Dec. 16, 1987

Related U.S. Application Data

[63] Continuation-in-part of Ser. No. 824,509, Jan. 31, 1986, abandoned.

[51] Int. Cl.[4] ..... E04H 12/18; B66F 11/04

[52] U.S. Cl. ..... 52/30; 52/115; 52/126.5; 52/143; 254/93 R; 91/4 R

[58] Field of Search ..... 182/63, 69; 52/143, 52/109, 2, 64, 30; 254/93 R, 93 L, 89 R; 187/8.41, 8.43, 8.45; 14/42, 1; 91/4 R; 92/53

[56] References Cited

U.S. PATENT DOCUMENTS 2,131,528 9/1938 Soyer ..... 52/2

*Primary Examiner*—John E. Murtagh

*Attorney, Agent, or Firm*—Maritide Co., Ltd.

[57] ABSTRACT

The present invention deals with a new hoisting and supporting machine used for supporting and lifting loads from the base level to different levels. The machine is essentially an air and water crane which is a combination of water pressure together with uplifting buoyancy forces acting directly or indirectly on the top platform of the hoisting machine. It consists generally of an outer upright water retaining telescopic column and an inner upright air filled floating telescopic column, which develops the buoyancy forces that lift up and support the top platform of the unit. When used in sub-zero temperature, the unit is provided with means to prevent the water, inside the column, from freezing, while for severe arctic low temperatures the unit is converted into an all ice column with provisions to accommodate the expanding ice inside the columns, resulting in an ice pillar acting like a concrete pillar to support the top platform of the unit with its loads.

14 Claims, 3 Drawing Sheets

AIR/WATER CRANES

This application is a continuation-in-part of Ser. No. 06/824,509 filed Jan. 31, 1986, now abandoned.

BACKGROUND OF THE INVENTION (A) Field of the Invention

The present invention deals with air and water hoisting equipment and the like. More particularly, the present invention relates to air and water cranes, and deals with hoisting machines using basically building up buoyancy forces to lift up and lower down loads between different levels, and to support them.

(B) Description of the Prior Art

For lifting, supporting, loading and unloading heavy loads, the industry uses heavy massive machinery using heavy supporting structures in conjunction with different diameter pulleys and cables, and pressurized fluid, forcing up pistons to lift up with their attachments to the required level.

Such hoisting systems are cumbersome, costly and heavy to transport and to move around and the fluid pressure requires special heavy steel cylinders and pistons to contain it and very elaborate joints to avoid escaping of the pressurized fluid.

Besides, to transport a large capacity crane from one country to another or from the city to the oil fields or the like, it would be very costly and sometimes impossible to get the crane where it is needed.

British Patent Specification No. 1,421,096 describes a pneumatic telescopic hoist which uses pressurized air or gas to lift up its loads. U.S. Pat. No. 3,734,464 discloses a control system for multi-stage lift which uses pressurized air to lift up its loads and keeps the lower stages overpressurized for better stability of the system.

SUMMARY OF THE INVENTION

It is an object of the present invention to use buoyancy forces to move loads between different levels, and to support them, and at the same time, to replace the heavy cumbersome structures required to support a crane boom, a liquid reservoir or the like.

It is another object of the present invention to provide air water cranes which can be transported in empty collapsed condition, so that when the unit is to be operated, air and water are available nearly everywhere and water can be moved in small quantities if needed or could also be pumped from neighboring water sources, contrary to the steel hoisting equipment used in the prior art which has to be moved with its full weight and full volume altogether and even when made in sections, the whole load and volume have to be transported long distances to the job site.

It is another object of the present invention to provide a hoisting device to lift a platform from zero elevation to a maximum and support it, comprising an upright container for containing a liquid, a buoyant body floating in said liquid and used to support a load, guiding means to guide said body in up-and-down movement in said container, means to progressively feed and discharge liquid into and from said container, and means to progressively feed and discharge gas into and from said buoyant body, both said container and said buoyant body acting simultaneously to lift from the ground and support said platform.

BRIEF DESCRIPTION OF THE DRAWINGS

FIG. 4 shows a set of independent air-water crane units used together to support an elevated water reservoir or the like.

FIG. 5 shows an air-water hoisting equipment using a plurality of telescopic air columns inside a common water column and supporting a crane boom or the like.

FIG. 6 shows an air/water hoisting equipment using a ring like telescopic air column inside the water column, supporting a watch tower or the like.

DESCRIPTION OF PREFERRED EMBODIMENTS

The present invention deals with new hoisting machines which hereinafter will be referred to as air/water cranes, used to lift up loads to different elevations, and to support loads at said elevations, using building up uplifting buoyancy forces, together with limited liquid pressure to lift from the base level and support a top platform capping the hoisting equipment.

Figure 1:
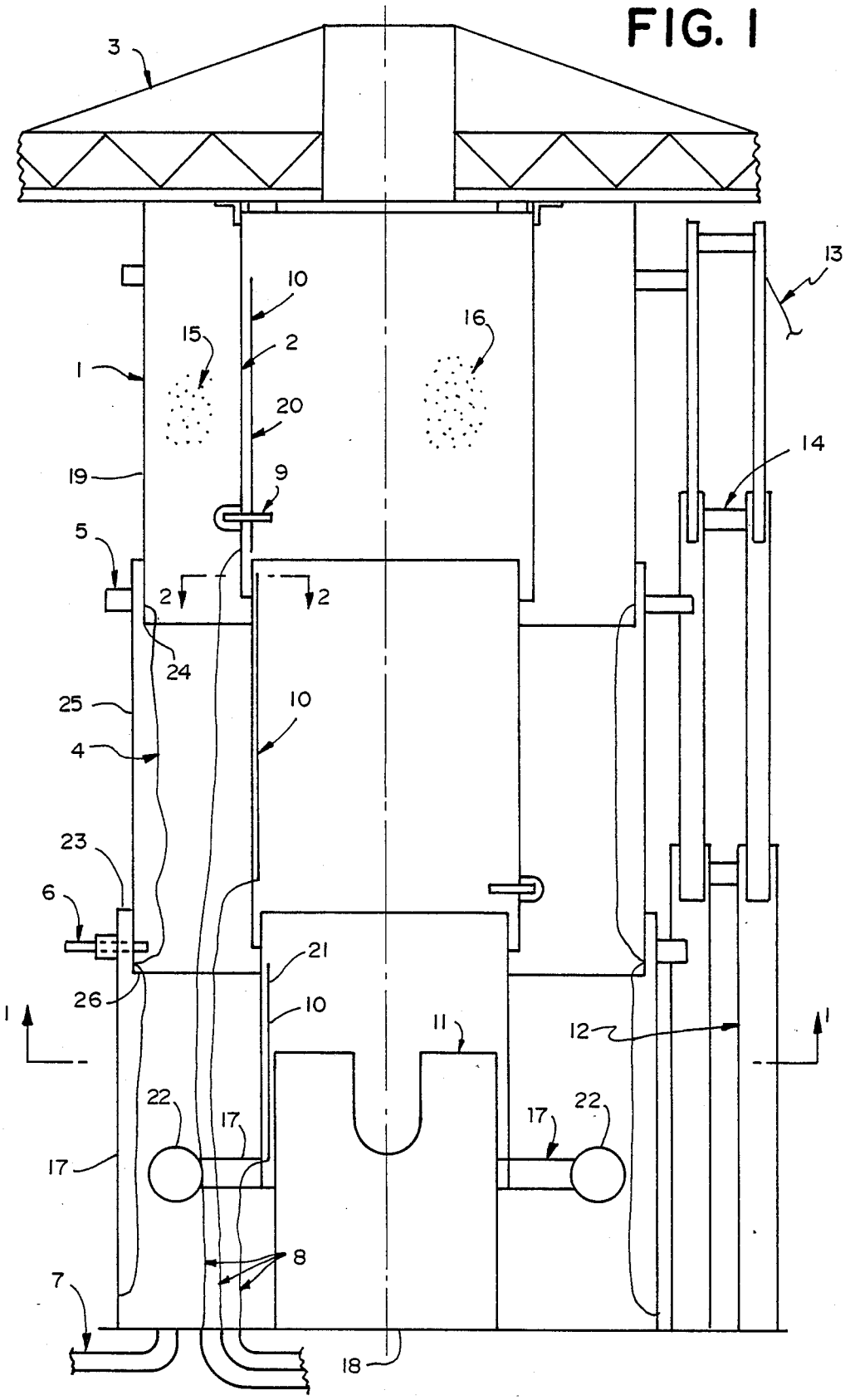
FIG. 1 is a longitudinal section of an air/water hoisting equipment.
Figure 2:
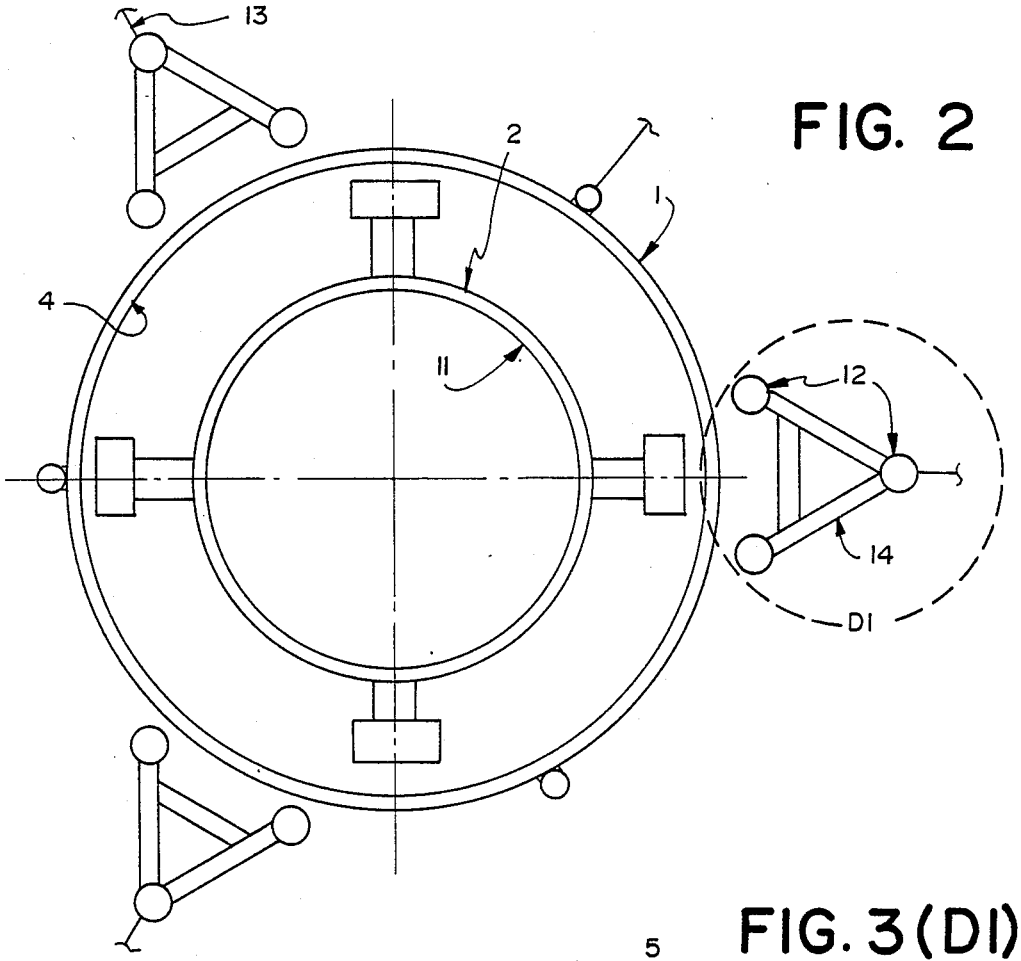
FIG. 2 is a cross-section of the air/water hoisting equipment taken along line 1—1 of FIG. 1.
Figure 3:
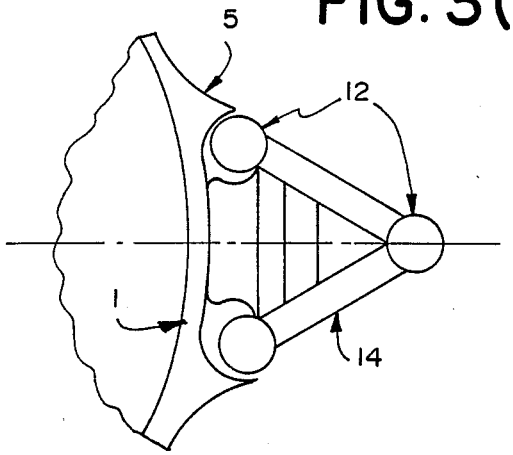
FIG. 3 shows details of the lateral stiffeners shown in FIG. 2.

With reference to FIG. 1 and FIG. 2, it will be seen that the above mentioned hoisting equipment is made basically of two concentric, telescopic, upright, solid columns 1 and 2.

The lower ring 17 of the outer telescopic column 1 is fixed to the base 18 of the unit and its top ring 19 is fixed to the top platform of the unit.

The outer telescopic column 1 is dimensioned to provide a small allowance above the inner air filled column 2 which is merely sufficient to prevent it from being pulled up and ripped off by the inner air filled uplifting column 2.

The inner air filled telescopic column 2 is fixed at its top ring 20 to the top platform 3, while its bottom ring 21 is free to slide up and down along the guide drum 11, which guide drum is fixed in known manner to the base 18.

In addition, the inner air column 2 is provided with spacers 17, fitted with rollers 22 to keep the column 2 at a certain space from the outer column 1, while the inner column 2 is lifting up high, above the guiding drum 11.

The inner telescopic column 2 is made of capped rings or cylinders closed at their upper ends and fitted inside each other as shown in FIG. 1, forming the sections of the column 2.

The upper capped rings of the inner telescopic column 2 are air filled at normal atmospheric pressure while the lower rings of the inner column have a slightly higher pressure enough to counterbalance the growing water pressure at the bottom of the air water column 2.

The area between the two concentric, telescopic columns 1 and 2 is filled with water, which fact creates large buoyancy forces in the inner air filled column 2 and forces the latter to push up and support the top platform 3.

Moreover, to increase the carrying capacity in the top platform 3, the water between the two concentric columns could be put under a certain pressure, which would act on the top platform 3 to increase its carrying capacity.

The air/water crane unit must be provided with standby makeup air and water pumps (known to those skilled in the art and not shown in the drawings) to compensate for any loss of air or water in the system.

Figure 6:
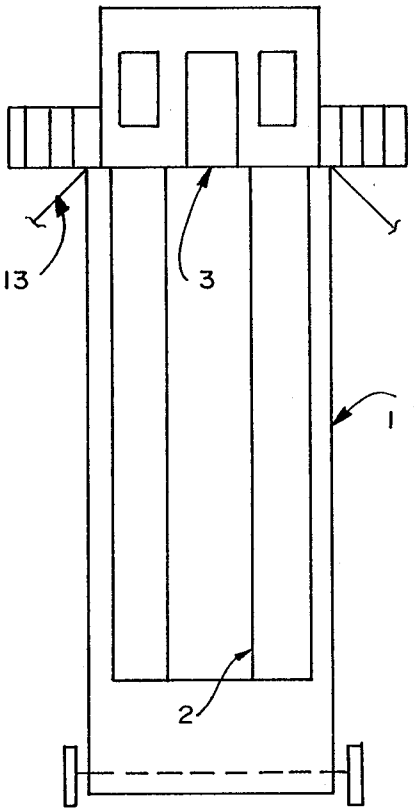
Figure 5:
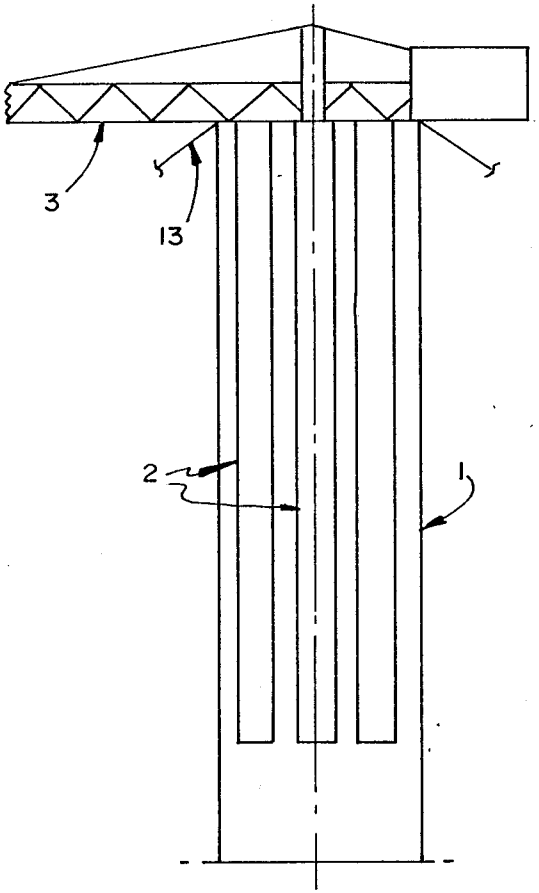
Figure 4:
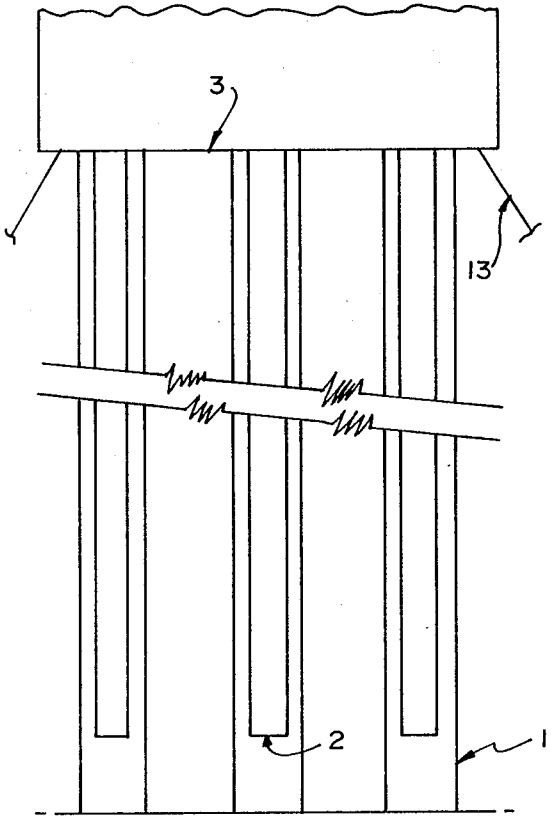

The top platform 3 can be used as a temporary or semi-permanent supporting structure (See FIGS. 4, 5, 6).

On the other hand, in normal operation, the top platform is fitted with a boom (not shown) and could be used as an overhead heavy duty crane that could raise, from the base level, and go down with its charge, discharging or filling air and water in the main column as required.

To prevent the water from seeping through the rings of the outer telescopic column 1, the latter is provided with an internal, impermeable, flexible membrane skirt, tightly fixed to the lower edge of each cylindrical ring, which skirt prevents the water from passing through while enabling the concentric cylinders to slide freely along each other.

The concentric sections of the outer telescopic column 1 are provided with stopper-reinforcing rings 5, to prevent these sections from reaching the sealed skirt and tearing it up. In retracted position, the stopper/reinforcing ring 5 rests against the upper edge 23 of the outer ring 25 immediately below, before the lower edge 24 of the inner ring 19 touches the membrane 4 connected at the lower edge 26 of the outer ring 25.

At the same time, the stopper rings engage and slide along the lateral support tubes 12, which fact ties the lateral supports to the main air/water crane unit.

The different rings of the concentric column are provided with latches 6, that engage the sections with each other to make the telescopic column act as one continuous piece.

The inner telescopic air column 2 is also provided with latches or pins 9 which may be spring loaded or the like (although this is not shown in the drawings), with remote control (not shown in the drawings), used to engage the different sections of the telescopic column 2 with each other, so that each section which is usually a capped air filled cylinder, does transfer its uplifting buoyancy force to the next section above it.

Figure 7:
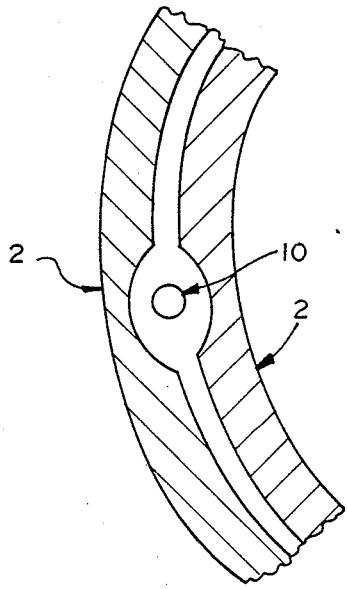
FIG. 7 is a cross-section view taken along line 2—2 of FIG. 1 through the walls of the telescopic air column shown on FIG. 1.

With reference to FIG. 7, it will be seen that the different sections of the inner air filled telescopic column 2 are provided with longitudinal guide rails 10, to prevent them for rotating one way or the other.

As shown in FIG. 7, the guide rail 10 is a solid air conduit extending vertically between adjacent rings 2, 2*a* and engaging half way through the wall adjacent rings 2, 2*a* to prevent them from rotating horizontally with respect to each other. At the same time this conduit serves to deliver compressed air under the cap at the top of each ring.

In other words, the tongue of the guide rail 10 is used as an air tube leading the air from the air hoses to the upper inner space of the capped cylindrical sections forming the inner air column 2.

The inner air filled telescopic column 2 is free to slide up and down along a guide drum 11, which is engaged inside the lower section of the air column and prevents it from moving laterally in any direction, thereby keeping it centered in place.

The inner telescopic air filled column is provided with separate flexible air supply hoses 8, connected individually through the tubes/guides 10, at the bottom of each capped section of the air column.

The air reaches the upper inner space of the caps through the said tube 10.

The lower capped sections of the inner air column have higher air pressure than the upper caps to counterbalance the higher water pressure at the lower part of the air/water crane unit.

The air/water crane unit is also provided with a water supply pipe to fill and pressurize the area between the inner and outer telescopic columns 1 and 2.

It is also provided with outside lateral supports 12, consisting of clusters of telescopic tubes connected to each other and engaging and sliding through the reinforcing rings 5.

The lateral supporting structures 12 are provided with guy ropes that are connected to distant points outside the unit, which fact gives the whole air/water crane unit strong lateral supports from all around.

At the same time, the top platform 2 is also provided with additional guy ropes, (not shown), to improve its lateral stability.

The whole air/water crane unit could be mounted on chassis and lifted on wheels, deflated to its minimum size and towed from place to place.

In addition, to allow transportation of the unit for short distances, on the job site, without collapsing the telescopic columns, the unit is provided with hinging system, (by known methods, not shown) allowing the unit to be tilted to a horizontal position, after being emptied from air and water, and to be towed for short distances on the job site.

For operation, the air/water crane unit can be lowered to rest on a flat, solid platform, with its boom adjusted for use, then it can be connected to air and water hoses and filled with air and water to grow and lift up from zero elevation to the required elevation with or without its load.

At the beginning, a high water pressure would help lifting the load of the unit and gradually the air column grows and replaces the water pressure to lift up the loads.

FIGS. 4, 5, 6 show that various operations would require various designs of the air/water crane unit. FIG. 4 shows a cluster of 3 independent air/water crane units lifting and supporting a temporary water tower.

The advantage of the plurality of independent units as shown in FIG. 4 is that it gives a better lateral stability to the structure.

FIG. 5 shows an air/water crane unit comprising a large outer water holding, telescopic column with a plurality of air columns inside the same outer column.

FIG. 6 shows an air/water crane unit using an inner telescopic air column made of hollow telescopic rings and allowing water to pass through the center of the telescopic air column as well as around it.

The advantage of replacing the one large inner air column with a plurality of smaller diameter air columns, or with a ring air column, is that it would allow the use of non-metallic, light weight material for the small diameter air columns and ring air columns, which fact reduces substantially the overall weight of the entire unit.

For non-metallic telescopic air columns, the latches, 6, are replaced with rings or the like to enlarge the area of engagement between the different sections of the telescopic air columns.

When the air/water crane unit is operated below freezing temperature, it has to be provided with means to prevent the water inside the column from freezing, such as:

A- A source of heat to keep the liquid inside the column at above freezing temperature.

B- To keep the water inside the column under a certain pressure.

C- To keep the water inside the column under constant circulation.

D- To add anti-freeze chemicals to the water.

E- To fill the column with low temperature freezing liquid instead of normal water, etc.

However, for operation under severe arctic subzero low temperature, the inner, usually air filled telescopic column 2 could be also filled with water instead of air, after being stretched to its maximum height, the same as the outer telescopic column, where the filling water would be allowed to freeze inside the columns which columns have to be lined at the surfaces in contact with the water, with: rubber, foam or any flexible, impermeable substance that could absorb the ice expansion inside the column and prevent the rupture of the said columns.

Under very low temperature, the ice column so formed, would act like a concrete pier to support the top platform of the unit with the superimposed load over it.

The resulting unit would be provided as well with heat sources (not shown) pre-installed through the ice column prior to the ice formation in the air/water crane column.

To move the frozen unit from one place to another, the heat source is activated to melt the ice inside the column, discharge the water and move the unit to a different location.

I claim:

1. A hoisting device to lift from base level and support a top platform comprising an upright container for containing a liquid, a buoyant body floating in said liquid and used to support a load, guiding means to guide said body in up-and-down movement in said container, means to progressively pressure feed and discharge liquid into and from said container, and means to progressively feed and discharge gas into and from said buoyant body, both said container and said buoyant body acting simultaneously through buoyancy and hydraulic pressure to lift and support said top platform, wherein both said container and said buoyant body consist of an outer and of an inner collapsible, telescopic column, respectively, wherein the inner column is made of a plurality of upright, hollow, capped elongated body sections being open at their bottom and capping one another, the body section of largest cross-section being at the top of the inner column.

2. A hoisting device as claimed in claim 1, wherein each body section has an annular cross-sectional shape allowing the liquid to fill the space inside as well as around the body.

3. A hoisting device as claimed in claim 1, wherein several inner columns are provided for floating in the liquid contained in said outer column.

4. A hoisting device as claimed in claim 1, wherein the outer column is concentric with respect to the inner column and comprises a purality of rings of gradually decreasing cross-sections, the ring with the largest cross-section being generally at the base of the outer column, the top edge of the upper most ring, and the bottom edge of the lowest ring, are closed, said outer column includes, at joints between adjacent rings, flexible skirts tightly joined to the lower edge of each of the adjacent rings to prevent liquid seepage at said joints.

5. A hoisting device as claimed in claim 1, wherein the different sections of the telescopic inner and outer columns are provided with means for latching adjacent sections with each other at the end of their lifting stroke, to transfer loads and stresses from one section to the other, resulting in solid inner and outer columns.

6. A hoisting device as claimed in claim 1, wherein said means to feed and discharge gas include individual gas supply conduits with different pressure for the different capped body sections of the telescopic inner column, to compensate for the pressure exerted by the water column, increasing with the depth of that water column in addition to the initial hydraulic pressure exerted by the pumping operation.

7. A hoisting device as claimed in claim 6, wherein at least some of said gas supply conduits include a solid conduit fixed to the wall of a capped body section and engaging a groove provided in an adjacent such section to prevent relative rotation of said adjacent sections and to deliver the air supply to the upper space inside the reversed caps.

8. A hoisting device as claimed in claim 1, comprising a collapsible, telescopic, air filled column floating inside a larger, liquid filled, collapsible, telescopic column where buoyancy forces of different sections of the air filled telescopic column together with hydraulic pressure act simultaneously, with the hydraulic pressure first, which is gradually replaced by the growing buoyancy forces of the building-up air column, to lift up from said base level and support a platform capping the telescopic columns.

9. A hoisting device as claimed in claim 1, (comprising outer telescopic structures) provided with outer lateral supports comprising tubular or angular structures, or the like, engaging into one another with latching devices, said lateral supports are pulled open by the rising hoisting device, provided with known mechanical means to prevent them from slipping back, to laterally support said device, (said outer telescopic structures), said outer lateral supports are distributed around the periphery of the outer column, fixed to the base of the hoisting device, with additional staggered guy ropes to give further stability to the hoisting device and prevented from swaying one way or the other. (the outer telescopic structure, constituting lateral supports, being tied with guy ropes connected to fixed points, spaced from said device, with staggered guy ropes connected to the top platform of the device and tied todiametrically opposed fixed points spaced from said device, said guy ropes all together giving the device further lateral stability, as the device builds up to higher elevations.)

10. A hoisting device as claimed in claim 1, comprising means enabling said device to be collapsed and mounted on wheels and pulled out to site, where it can be lowered to allow the base of said device to rest on solid ground (and means to connect said device to air and water supply sources to fill same with air and water to lift same, from the base level, to desired elevation, and in certain cases, if the device has to lift up with its load, the water pressure is set up high at the beginning, until the air column opens up and gradually replaces the water pressure to lift up the top platform with its superimposed loads and related attachments).

11. A hoisting device as in claim 1, used to support a lookout cabin or a watch tower in the vicinity of residential homes, generally combined with a water pool, swimming pool or the like, using the water of the pool to fill up the water column, while raising the platform to the required elevation, provided with a mini elevator, with means of lateral support and with means enabling said device to be collapsed and stored aside and when required, to be filled with air and water to lift up, from the base level to the required elevation, to be used as a lookout watch tower with the mini elevator used to transfer people between the ground and the said watch tower raised over the platform capping the hoisting unit.

12. A hoisting device as in claim 1, comprising means to prevent the water inside the liquid filled column from freezing in operations at below freezing temperature.

13. A hoisting device as claimed in claim 1, for operations under severe sub-zero temperature, comprising means allowing water to fill both the telescopic columns and to freeze inside said columns, said columns being lined with compressible lining to prevent expanding freezing water, inside the columns, from bursting said columns, said frozen water forming a solid block that acts like a solid pier to support the top platform including a hoisting unit with its load, said hoisting unit being provided with heat source throughout the column, that is used to melt the ice column formed therein, in preparing the device for emptying and removing.

14. A group of hoisting devices as claimed in claim 1 and 3, assembled in different groups for hoisting and supporting loads as the necessity requires.

* * * * *